US005760340A

United States Patent [19]

Orr, Jr. et al.

[11] Patent Number: 5,760,340

[45] Date of Patent: Jun. 2, 1998

[54] WOVEN MULTI-LAYER ELECTRICAL CABLE

[75] Inventors: Lawrence William Orr, Jr., Simpsonville; Kathryne R. Hammett, Piedmont; Sharon Ledbetter Adams, Greenville, all of S.C.

[73] Assignee: Woven Electronics Corporation, Simpsonville, S.C.

[21] Appl. No.: 707,650

[22] Filed: Sep. 5, 1996

[51] Int. Cl.[6] ..... H01B 7/08

[52] U.S. Cl. ..... 174/117 F; 174/117 M; 174/36

[58] Field of Search ..... 174/117 F, 117 M, 174/36

[56] References Cited

U.S. PATENT DOCUMENTS

| | | | |
|---|---|---|---|
| 2,959,634 | 11/1960 | Lyon | 174/117 F |
| 3,582,537 | 6/1971 | Perreault | 174/117 F |
| 4,158,104 | 6/1979 | Ross | 174/117 M |
| 4,746,766 | 5/1988 | Soulard | 174/36 |
| 4,777,326 | 10/1988 | Zamborelli | 174/36 |
| 4,808,771 | 2/1989 | Orr, Jr. | 174/72 R |
| 4,818,820 | 4/1989 | LaRock | 174/36 |
| 4,847,443 | 7/1989 | Basconi | 174/32 |
| 4,956,524 | 9/1990 | Karkow | 174/117 M |
| 5,126,512 | 6/1992 | Derry | 174/117 M |
| 5,331,115 | 7/1994 | Ysbrand | 174/117 M |
| 5,552,565 | 9/1996 | Cartier et al. | 174/117 F |

OTHER PUBLICATIONS

The "Condensed Chemical Dictionary" Revised by Gessner G. Hawley, 1971.

*Primary Examiner*—Hyung S. Sough
*Assistant Examiner*—Chau N. Nguyen
*Attorney, Agent, or Firm*—Cort Flint; Henry Jaudon

[57] ABSTRACT

A woven transmission cable formed of a plurality of conductor wires arranged in side-by-side relationship forming an array which extends along a single plane. Coating the conductor wires with a self lubricating insulating material and separating them with warp yarns which are located between adjacent ones thereof. Weaving a weft yarn, formed also of a self lubricating material, to pass alternately over and under the warp yarns and the wires of the array, forming a woven structure in which the wires are capable of longitudinal adjustment relative to the warp yarns and the weft yarns. The longitudinal adjustment allows the cable to be shaped into an arcuate configuration while maintaining the wires along a single plane.

11 Claims, 4 Drawing Sheets

WOVEN MULTI-LAYER ELECTRICAL CABLE

BACKGROUND OF THE INVENTION

The instant invention is directed to an insulated flexible electrical cable particularly adapted for use as a connector between the stationary body and the oscillating portion of hover aircraft and helicopters. To accomplish this objective, the cable must be adaptable within a confined area and must be capable of back and forth motion about an arcuate path. These functions must be accomplished while the individual conductors of each array forming the layers of the cable are maintained in equidistant and aligned positions. The cable must also have an insulating and heat resistant capability to function at temperatures of between 50° and 200° C.

Flexible electrical cables which move along reciprocal paths while in use are known as illustrated in U.S. Pat. Nos. 2,959,634 and 4,746,766. These structures are not multi-layered and are not attached with an arcuate mount. Similarly, U.S. Pat. Nos. 4,808,771 and 5,331,115 disclose electrical cables which may be formed multi-layer and which include branch members which diverge from the main body. Also, U.S. Pat. No. 5,126,512 is directed to an electrical cable formed with a portion which extends about an arcuate path. None of these patents are concerned with the structural and operational requirements to which the cable of the invention must conform.

It is an object of the instant invention to provide a multi-layered electrical cable having an arcuate portion in which the conductor wires remain along a continuous plane throughout.

Another object of the invention is to provide a woven electrical cable in which the weave allows the conductors of each array to lie along a single plane.

Another object of the invention is to provide a woven cable in which the outside surface of at least a portion of the forming members consist of a self-lubricating material.

Another object of the invention is an electrical cable having insulating qualities allowing it to function at between 50° and 200° C.

Another object of the invention is an electrical cable structure which allows longitudinal shifting of the conductors.

Another object of the invention is the provision of an electrical cable in which the conductors remain evenly spaced and aligned during arcuate reciprocal motion of the cable.

SUMMARY OF THE INVENTION

The present invention accomplishes the above objects by providing a self aligning woven transmission cable mounted for reversing movement along an arcuate path. The cable is constructed of a plurality of coated insulated conductor wires arranged to extend in side-by-side relationship and along a single plane to form an array. The coating comprises of a self lubricating synthetic material which accommodates longitudinal shifting of the wires. A plurality of non-conductor warp yarns are arranged across the array between alternate wires. A weft yarn is interwoven with the warp yarns and woven to successively pass over and under the conductor wires. The weft yarn acts to position the conductor wires along a single plane.

A plurality of the arrays each formed of conductor wires, warp yarns and weft yarns are arranged in adjoining relationship and united into a cable. A metal shield is located between each of the arrays and secured therewith to form a unitary multi-layer cable. An outer cover shield is positioned about the cable.

The cable is positioned on its edge about an arcuate member with successive of the wires forming each of the arrays extending radially outward from the arcuate member while maintaining alignment along a single plane.

Movement of the arcuate member causes the individual wires of each array to shift slightly longitudinally thereby allowing the wires to maintain their alignment along the single plane. This movement is made possible because of the self lubricating coating material and the selected weave pattern.

A woven transmission cable formed of a plurality of conductor wires arranged in adjoining relationship and forming an array along a single plain. The wires are coated with a self lubricating insulating material such as TEFLON which is a fluorocarbon resin including polytetrafluoroethylene, perfluoropropylene resin and copolymers. There are a plurality of warp yarns arranged in an undulating manner along the referred to plane and located between adjacent of the wires. A weft yarn, formed also of a self lubricating material, is arranged to pass alternately over and under the warp yarns. The weft yarn also passes first over and then under the array of wires. The weft yarn passes are arranged at no more than twelve per inch. The described weave provides a stable structure in which the wires are capable of longitudinal adjustment.

The array is arranged in an arcuate configuration and the wires are adjusted longitudinally which allows them to remain along the single plane. A plurality of the arcuately configured arrays are arranged in adjoining relationship to form a multi-layered cable. A metallic shield is located between each of the arrays. The metallic shields are shaped to conform with the arcuate configuration of the arrays.

A woven electrical cable having a thermal capability of between 50° and 200° C. is constructed to have a generally flat portion and an arcuate position. The cable includes at least one array comprising a plurality of conductors and a plurality of warp yarns arranged in alternating manner. A continuous weft yarn is interwoven with the conductors and the warp yarns in such a manner as to allow the conductors to lie along a single plane. A plurality of arrays may be arranged in adjoining relationship to form a multi-layered cable. The cable is formed so that the referred to plane is perpendicular to the plane of the arc formed by the arcuate portion.

The invention includes a method of forming a woven electrical cable having a straight portion and arcuate portion. The method includes steps of:

(1) providing a plurality of conductors coated with a self lubricating insulating material and arranging the conductors in an array along a single plane;

(2) separating the conductors with warp yarns;

(3) interweaving the warp yarns and conductors with weft yarn formed of a self-lubricating material;

(4) arranging the array about an arcuate path with the plane of the array extending perpendicularly of the plane of the arcuate path; and (5) maintaining the conductors along a single plane during their arrangement about the arcuate path by causing them to shift longitudinally of their axes.

The method includes arranging a plurality of arrays of conductors side-by-side and separating the arranged arrays with metal shields. Securing the arranged shields about an arcuate support while maintaining the arrays of conductors aligned along the single plane.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 8:
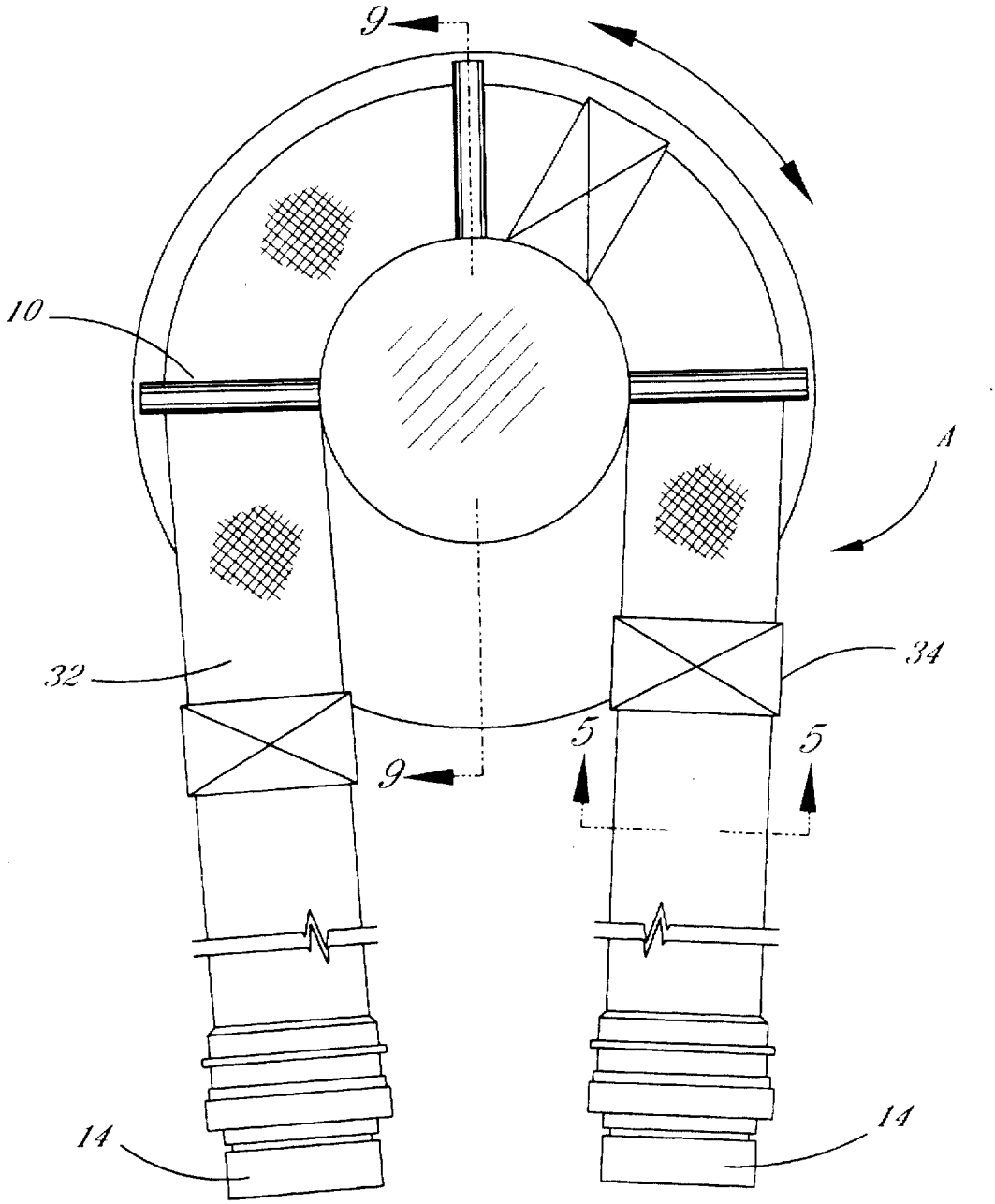
FIG. 8 is a side view of the cable positioned with a reciprocating mount.
Figure 9:
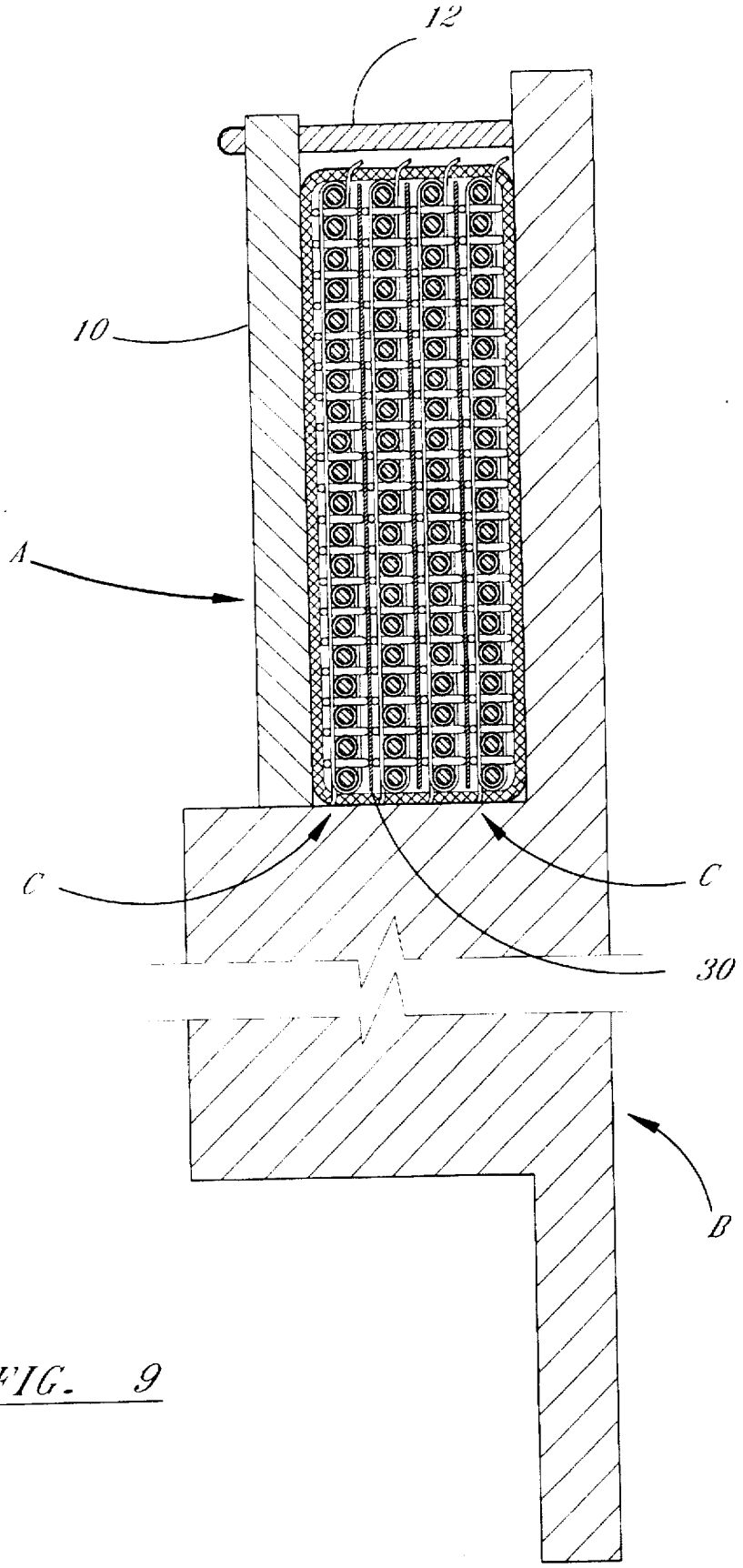
FIG. 9 is a sectional view taken along lines 9—9 of FIG. 8.

Turning first to FIG. 8 and 9, the electrical cable A of the invention is shown mounted about an arcuate portion of disc B. Cable A is secured to the periphery of disc B with bindings 12 secured with pins 10. Connectors 14 are connected with the end portions of cable A to be connected in usual manner with other connectors. Disc B is reciprocally driven as indicated by the arrow.

Cable A is constructed as shown in FIGS. 1–5 of a plurality of arrays C arranged in adjoining relationship. Each array C is formed of a plurality of insulated conductor wires 16 arranged along a single plane in adjoining relationship. A single warp yarn is located between each adjacent pair of conductor wires 16. A weft yarn 20 is passed in the form of successive picks back and forth across the array of conductor wires 16 and warp yarns 18, passing first over all conductors and under all warp yarns and then beneath all conductors and over all warp yarns. This weave, as best shown in FIGS. 1–4 separates the conductors 16 along their length and allows them to lie or be positioned along a single plane throughout the entire length of the cable.

Each conductor 16 consists of a metallic wire core 24 and a self lubricating and insulating cover 26. Wire core 24 may comprise a single filament or a plurality of filaments and is formed to be between sixteen and twenty-eight gauge. Polytetraflorene (TEFLON), which is a fluorocarbon resin including polytetrafluoroethylene, perfluoropropylene resin and copolymers (TEFLON), is employed as cover 26 because of its self lubricating or lubricous characteristics and because it is an adequate insulator. TEFLON is also sufficiently heat resistant being capable of functioning at between 50° and 200° C. Other coating material having the above described capabilities could be used.

Weft yarn 20 is preferably formed of a continuous strip of TEFLON which comprises fluorocarbon resins including polytetrafluoroethylene. The strip is interlaced with conductor wires 16 and warp yarns 18 in a spaced manner creating a loose weave. There are no more than twelve passes per inch of weft yarn 16 along the length of the cable. Other synthetics may be used as the weft yarn so long as they possess the necessary characteristics.

Warp yarns 18 which are preferably formed of continuous filaments of TEFLON may however be formed of nylon or other suitable synthetic material. Critical requirements are adequate heat resisting capabilities and sufficient lubricating capabilities.

Figure 6:
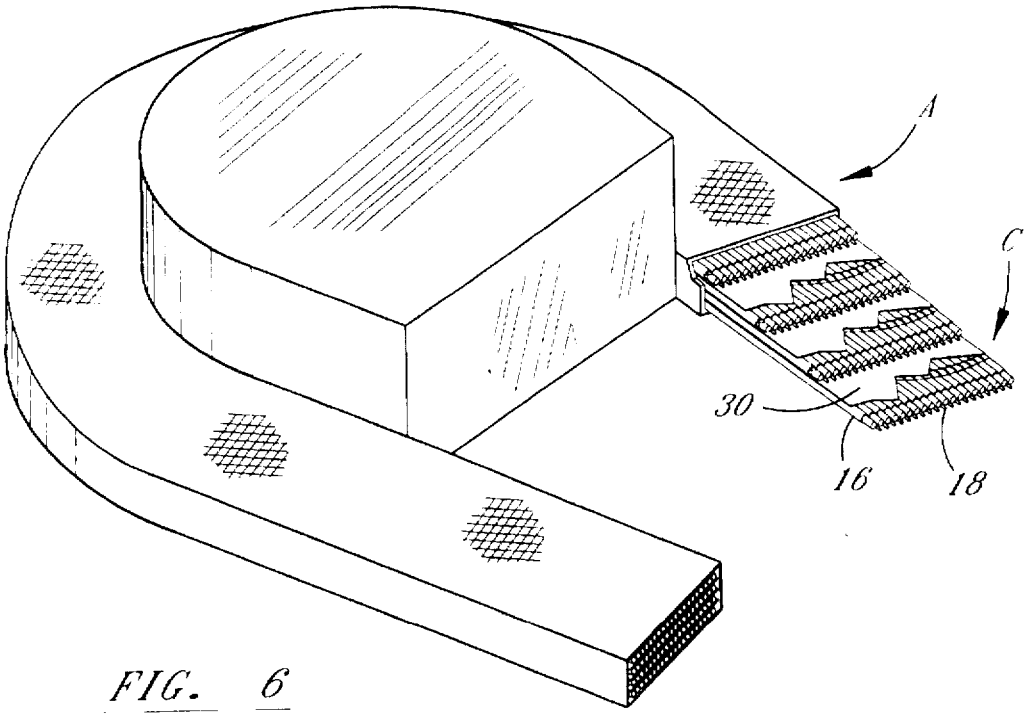
FIG. 6 is a perspective view of the mold and cable configured about the mold.

After weaving, each array A is positioned about an arcuate shaped mold D as shown in FIG. 6. The array is positioned with an edge wire 16 located adjacent mold D with the remaining wires being arranged successively outward from the mold. FIG. 6 shows the plane of contacting surface of mold D extending vertically while the plane along which wires 16 lie extends horizontally and transversely of that plane.

In order to arcuately configure wires 16 and still maintain them along their designated plane, it is necessary to shift them slightly along their longitudinal axis across the width of the array. Once wires 16 have been shifted, array C which is now configured as shown in FIG. 7 is ready to have a second array C positioned adjacent thereto and about mold D and configured as described.

Before the second array C is placed about mold D, a metallic shield 30 is placed over the first array in position to separate the arrays as shown in FIG. 6. Shields 30 also lie along the single plane which arrays C lie and act to separate the conductor wires of adjacent arrays. The number of layers is optional as determined by the requirements of the cable.

Figure 7:
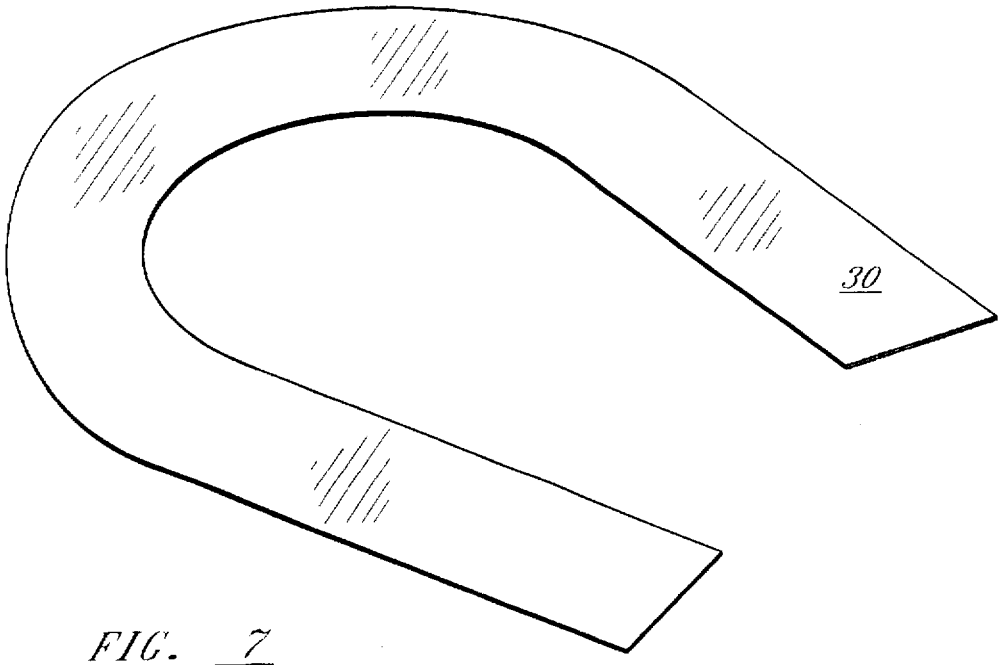
FIG. 7 is a perspective view of the arcuate configuration of the shaped metal shield which separates the layers of arrays forming the cable of the invention and of the arcuate configuration of the arrays.

The metallic shields 30 are cut and configured substantially as shown in FIG. 7. The shields are preferably copper and between 3 and 5 thousandths of an inch thick.

Figure 1:
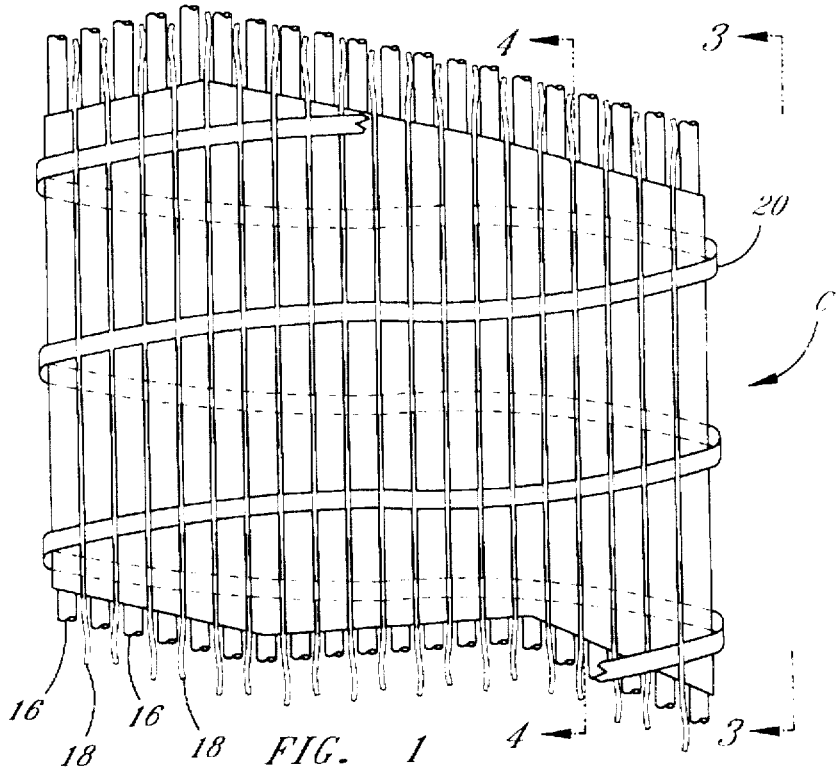
FIG. 1 is a cut away top view of an array of the cable of the invention.
Figure 2:
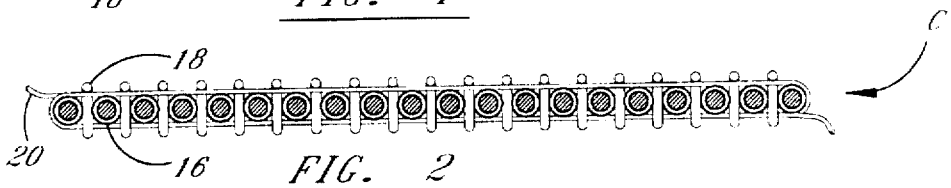
FIG. 2 is a cut away end view of FIG. 1.
Figure 3:
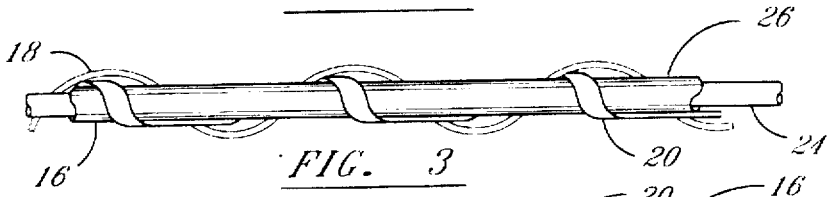
FIG. 3 is a cut away side view taken along lines 3—3 of FIG. 1.
Figure 4:
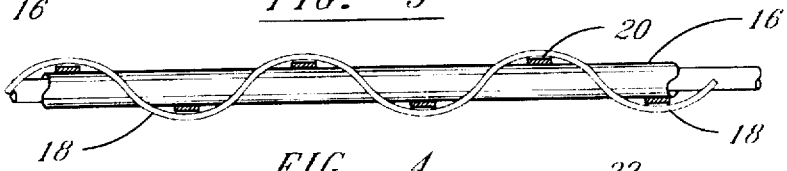
FIG. 4 a cut away side view taken along lines 4—4 of FIG. 1.
Figure 5:
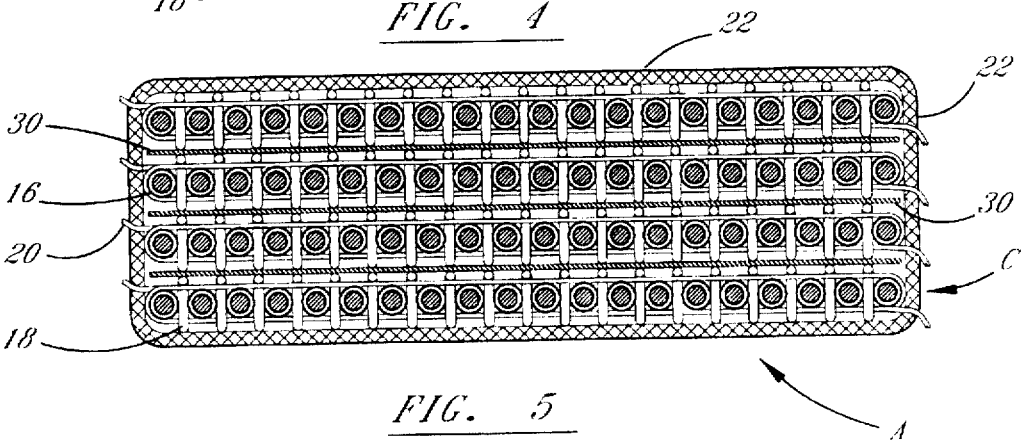
FIG. 5 a cut away end view taken along lines 5—5 of FIG. 8.

Cable A formed to be multi-layered as shown in FIGS. 5, 6, and 9 is constructed with each layer or array C separated with a metallic shield 30, so that each wire 16 is separated and spaced equidistant from adjacent wires 16 by warp yarns 18 and from wires of adjacent arrays by shields 30. Ties, arranged at spaced intervals retain the individual layers of arrays C in fixed relative position. A fabricated shield or cover 32, preferably braided, surrounds the stacked layers of arrays. Binders 34, as shown in FIG. 8, may be applied to further stabilize the cable. The cover is of usual construction and forms no part of the instant invention.

Cable A is now secured about the periphery of disc B with an edge wire 16 of each array C adjacent the peripheral surface of disk B and with all of its wires 16 extending along a single plane. This plane is perpendicular to the plane of the disc. See FIGS. 8 and 9. As wires 16 have been longitudinally adjusted, there is no overlapping or misalignment. The maintenance of alignment is absolutely necessary in order to insure that the electrical characteristics transmitted are not altered.

In operation, disc B moves through a short reciprocal or back and forth motion carrying cable A with it. Because of the lubricating surfaces of coating 26, weft yarn 20 and warp yarns 18, a slight longitudinal shifting of the conductor wires occurs during each direction of motion of disc B. This shifting allows the conductor wires 16 to maintain their position along the single plane with no overlapping or misalignment occurring.

While a preferred embodiment of the invention has been described using specific terms, such description is for illustrative purposes only, and it is to be understood that changes and variations may be made without departing from the spirit or scope of the following claims.

What is claimed is:

1. A self-aligning woven transmission cable comprising:

a plurality of coated insulated conductor wires forming at least one array, said wires being arranged to extend in side-by-side relationship along a single plane, said coated wires coated with a self-lubricating material which provides a substantially frictionless outer surface;

a plurality of non-conductive warp yarns arranged across said at least one array and between said wires; a weft yarn interwoven with said warp yarns and said wires in a plurality of picks, each of said picks passing completely across said at least one array and successively over and under said wires in said single plane;

an arcuate path provided on a portion of said cable wherein at said arcuate portion, said weft yarn still passing successively first over and under each of said wires then over and under each of said warp yarns to maintain said wires in said single plane;

said at least one array comprising a plurality of arrays in adjoining relationship to form said transmission cable which is a unitary cable and also comprises said arcuate path and a metal shield member between each of said arrays within said transmission cable.

2. A woven transmission cable of selected weave shaped into an arcuate configuration comprising:

a plurality of conductor wires arranged in spaced side-by-side relationship along a single plane forming at least one array, said wires being coated with a self lubricating insulating material which provides a substantially frictionless outer surface;

a plurality of warp yarns arranged between each of said conductor wires forming said array, said warp yarns being positioned in undulating manner along said single plane;

a weft yarn passing in successive picks completely across said array while being positioned alternately over and under each of said warp yarns and first under and then over each of said conductor wires of said array along the entire length of said array;

said at least one array comprising a plurality of arrays in adjoining relationship and a metal shield provided adjacent each of said arrays wherein each of said shields and each array of said arrays being secured together to form said woven cable as a unitary cable; and causing a portion of said unitary cable to be shaped into said arcuate configuration with said weft yarn remaining positioned over and under each of said conductor wires and each of said warp yarns along said arcuate configuration to retain said conductor wires of each of said arrays aligned along said single plane.

3. The cable of claim 2 wherein said self-lubricating insulating material includes polytetrafluoroethylene.

4. The cable of claim 2 wherein said weft yarn includes polytetrafluoroethylene.

5. The cable of claim 2 wherein said weft yarn comprises a shaped monofilament including polytetrafluoroethylene.

6. The cable of claim 2 wherein said warp yarns include polytetrafluoroethylene.

7. The cable of claim 2 wherein said warp yarns comprise synthetic monofilaments.

8. The cable of claim 2 wherein said metal shields comprises copper foil.

9. The cable of claim 2 including a tubular outer shield in which said unitary cable is encased.

10. The cable of claim 2 wherein said conductor wires of each of said arrays are adjusted longitudinally allowing said unitary cable to conform into said arcuate configuration with said conductor wires remaining along said single plane.

11. The cable of claim 2 wherein said metal shields are shaped to conform with said arcuate configuration of said arrays.

* * * * *